United States Patent [19]

Mori

[11] Patent Number: 4,693,104

[45] Date of Patent: Sep. 15, 1987

[54] PROCESS FOR MANUFACTURING A SINGLE PIECE ALUMINUM ALLOY WHEEL RIM FOR VEHICLE TIRES

[76] Inventor: Hiroshi Mori, 2751 Aqua Verde Cir., Los Angeles, Calif. 90077

[21] Appl. No.: 721,172

[22] Filed: Apr. 8, 1985

[51] Int. Cl.[4] ..... B21H 1/10

[52] U.S. Cl. ..... 72/68; 72/354

[58] Field of Search ..... 72/68, 354; 29/159.1

[56] References Cited

U.S. PATENT DOCUMENTS 2,633,765 4/1953 Glasner ..... 72/354
3,443,411 5/1969 Anthony ..... 72/257

FOREIGN PATENT DOCUMENTS 10385 1/1980 Japan ..... 29/159.1
718076 11/1954 United Kingdom ..... 72/354

*Primary Examiner*—Lowell A. Larson
*Attorney, Agent, or Firm*—Lyon & Lyon

[57] ABSTRACT

A process for forming a single piece rim for vehicle tires comprising the steps of deforming a toroid of aluminum alloy material in axial opposite directions so as to form a hollow tubular element of predetermined length and thickness having an annular inwardly directed radial flange intermediary of the ends thereof and spaced predetermined distances from the element ends and spin forming the ends of the element outwardly and axially to shape the inner and outer rim and define an inner rim flange and an outer rim flange.

4 Claims, 6 Drawing Figures

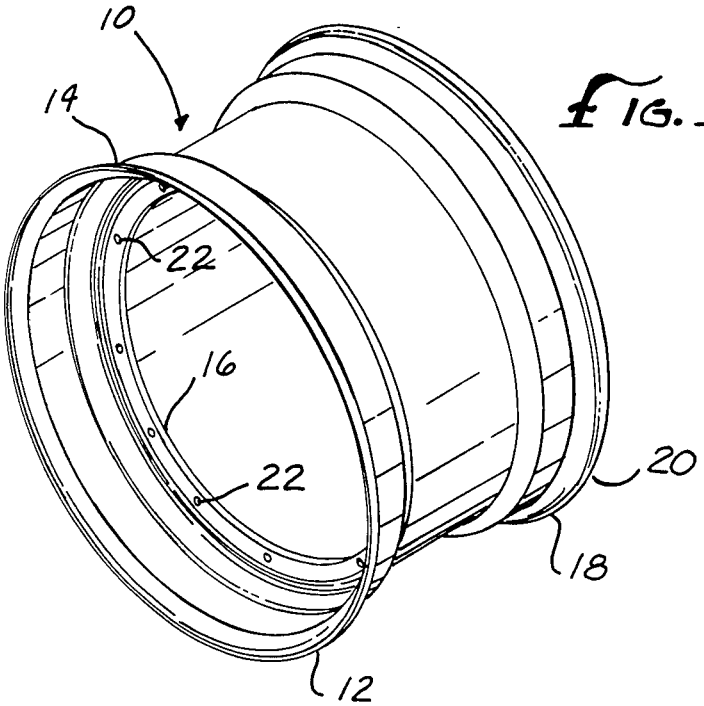
FIG. 1.
FIG. 2.
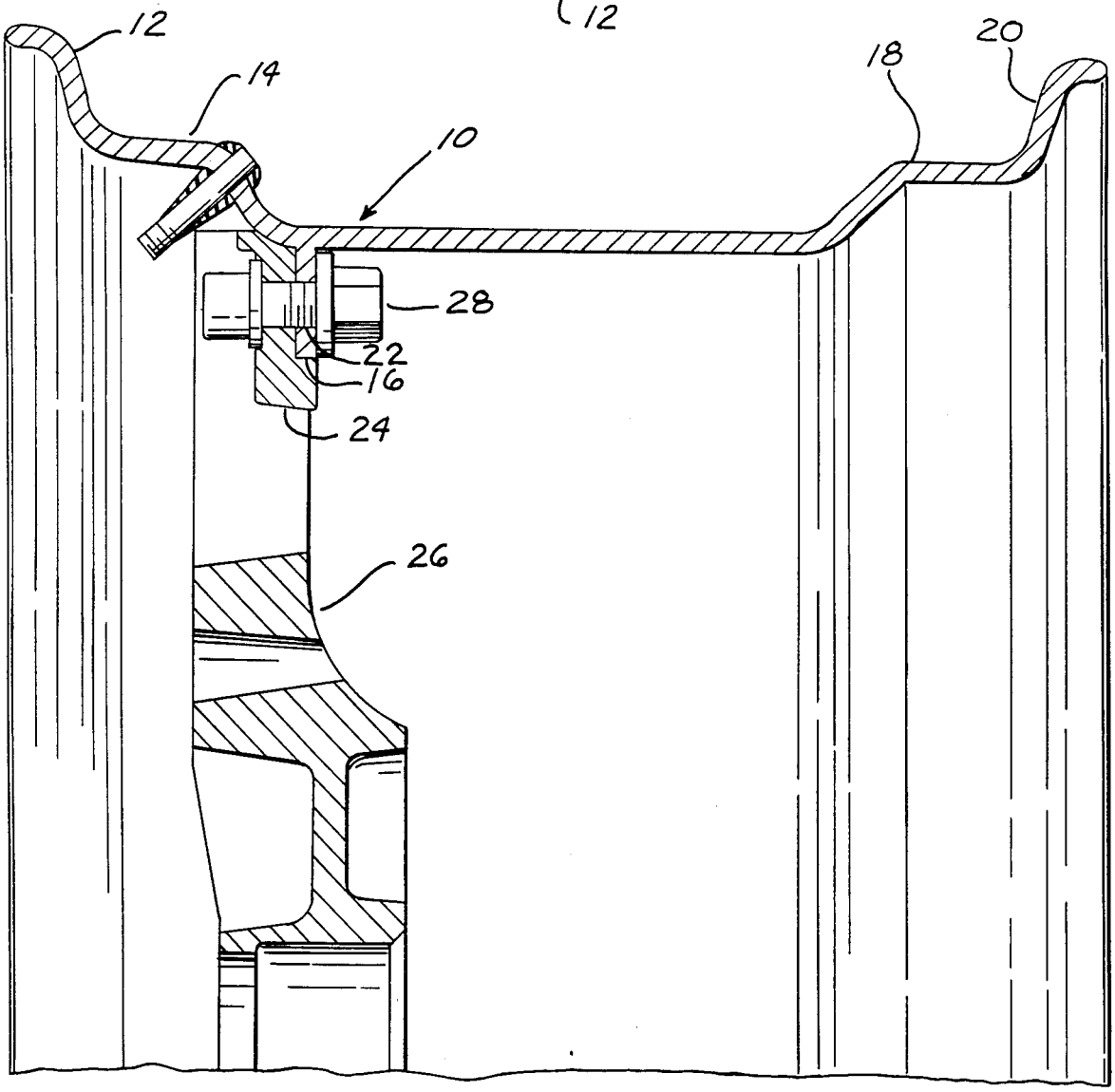

PROCESS FOR MANUFACTURING A SINGLE PIECE ALUMINUM ALLOY WHEEL RIM FOR VEHICLE TIRES

BACKGROUND OF THE INVENTION

The present invention relates to a method of manufacturing a single piece aluminum alloy wheel rim for vehicle tires. Vehicle wheels constructed of aluminum alloys are quite popular due to their aesthetic appearance and light weight. Because aluminum alloys are not readily susceptible to welding due to the deleterious effect of the welding process on the strength of the metal, it has been standard practice to manufacture separately the disc or wheel center and the inner and outer rims and subsequently to assemble the component parts by a suitable fastening means such as a plurality of threaded bolts. Such wheels are commonly referenced to as three-piece wheels.

Three-piece wheels generally comprise superposed radial directed flanges extending from the inner and outer rims which are secured to a peripheral mounting on the wheel center by the fastening means. The problem inherent in such structures are inadequate are strength and leakage. Inadequate strength, in addition to the obvious safety problems, has prevented such wheels from employing a desirable positive wheel offset which is highly advantageous particularly for front wheel drive vehicles to provide a greater area for larger breaking drums for improved breaking performance while complying with existing wheel placement regulations. In an effort to solve these problems, numerous different three-piece wheel configurations have been developed. For example, U.S. Pat. No. 4,466,670 teaches a configuration which provides improved strength characteristics over previously developed three-piece wheels and employs a silicon seal to prevent leakage. Applicant's co-pending application Ser. No. 06,721,045 filed 4/8/85 employs a rim design which provides sufficient strength to maximize the positive wheel offset. Nevertheless, regardless of the design, the necessity to manufacture and subsequently secure together the inner and outer rims necessarily increases the cost of manufacture. It would therefore be highly desirable to develop a method of manufacturing a single piece aluminum alloy rim for use with conventional alloy wheel centers which would reduce assembly time and the cost of manufacture while maximizing strength. Because such a rim requires a radial flange or base for its securement to the wheel center and aluminum alloys cannot be readily welded without weakening the resultant rim, such wheels have not been heretofore available. The method of manufacture disclosed herein provides such a single piece flanged rim.

SUMMARY OF THE INVENTION

Briefly, the present invention comprises the application of high pressure to a pair of oppositely disposed inwardly moving dies which press against a solid toroid of the material of which the wheel is to be constructed to form a tube of a predetermined given length having a radially extending inner annular flange disposed intermediary of the ends thereof at a predetermined location. The ends of the tube are subsequently subjected to a sheet metal spinning process forming the inner and outer rim flanges and the desired contour of the wheel rim.

It is the principal object of the present invention to provide a method of manufacturing a single piece wheel rim for vehicle tires constructed of an aluminum alloy material and having a radially directed base integrally formed thereon for securement to a conventional alloy wheel center.

It is another object of the present invention to provide a method of manufacturing a single piece wheel rim for vehicle tires which allows for the placement of the radial directed base at any desired location along the rim to obtain any desired wheel offset without adversely affecting the strength of the wheel.

These and other objects and advantages of the present invention will become readily apparent from the following detailed description taken in conjunction with the accompanying drawings.

BRIEF DESCRIPTION OF THE DRAWINGS

FIG. 1 is a perspective view of a wheel rim constructed in accordance with the present invention.

FIG. 2 is a sectional view of a wheel rim constructed in accordance with the present invention showing the rim secured to a wheel center.

DESCRIPTION OF THE PREFERRED EMBODIMENT

Figure 3:
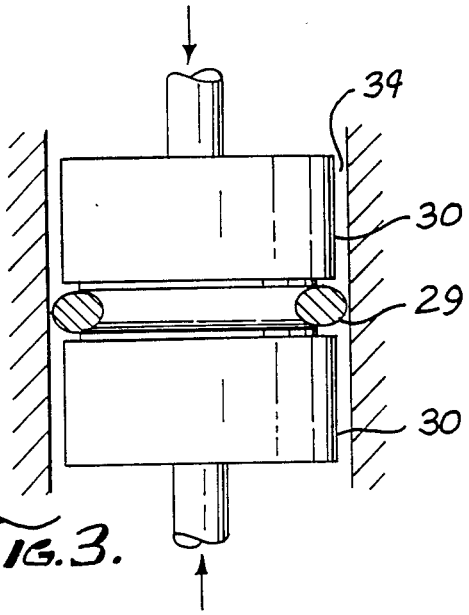
FIGS. 3 and 4 are schematic representations of the forming of the toroid by pressing dies into a tube having an inwardly directed radial flange.

The single piece alloy rim 10 of the present invention is illustrated in FIGS. 1 and 2. As seen therein the rim comprises an outer rim flange 12, outer rim portion 14, a radially directed flange or base 16, inner rim portion 18 and an inner rim flange 20. The outer and inner rim flanges 12 and 20 cooperate to accommodate a vehicle tire in the conventional manner. The radially directed flange 16 is provided with a plurality of spaced apertures 22 extending therethrough for securement to the ring mount 24 on a conventional alloy wheel center 26 by a corresponding plurality of threaded fastening members 28.

Figure 4:
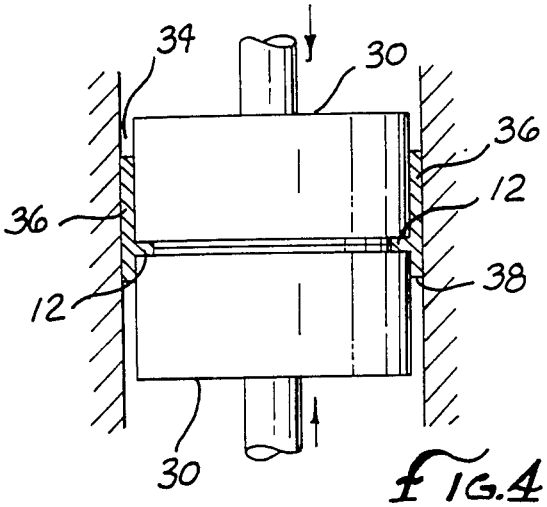
Figure 5:
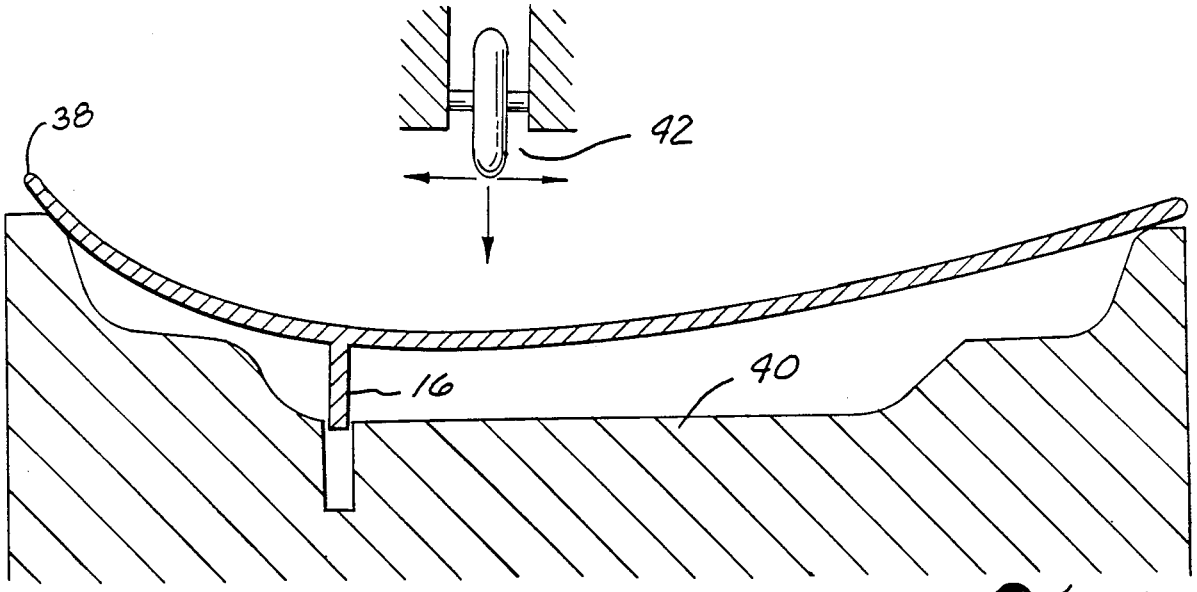
FIG. 5 is a schematic representation of the sheet metal spinning of the formed tube into the desired rim curvatures and to impart the rim flanges to the extended ends thereof.

The process for manufacturing the rim 10 is illustrated in FIGS. 3-5. As seen therein, toroid 29 of the material of which the wheel is to be fabricated, is placed between a pair of high pressure double press dies 30 in a cavity 34. The dies are moved inwardly under high pressure of about 12,000 tons causing the metal to flow about and between the dies as seen in FIG. 5 to form the toroid 29 of material into a tube configuration 36 having an integrally formed inwardly directed radial flange 12. By varying the axial pressure and movement of the dies 30 in relation to the size of toroid 29 and the desired thickness of the resultant tube 36, the length of the tube 36 and desired disposition of the radial flange 16 with respect to the ends of the tube can be achieved. If necessary or desired, the tube can be further sized by severing the ends of the tube 30 so as to provide the tube with the desired length for the particular rim to be manufactured while spacing the radial flange 16 the desired distance from the tube ends. The spacing of the formed radial flange 16 from outer end 38 of the tube determines the desired amount of wheel offset as will become apparent.

By way of example, a six pound toroid of aluminum alloy material having an outside diameter of about six inches and an inside diameter of about four inches could be used in the aforesaid process to form a tube 30 of about eight inches in length, having a wall thickness of about 5 mm.

The formed tube 30 is next subjected to a conventional sheet metal spinning process employing a spinning die 40 and movable roller 42 illustrated in FIG. 5 to impart the desired curvature to the outer and inner rim portions 14 and 18 of the finished rim 10 and to impart to the extended ends of the rim the outer and inner rim flanges 12 and 20. The rim mounting apertures 22 are then drilled through the radial flange 16 to accommodate the threaded fastening members 28 for subsequent securement of the rim 10 to the wheel center 26. A single aperture 44 is also drilled through formed outer rim portion 14 to accommodate a tire valve stem 46. Finally, the rim is polished as desired.

Figure 6:
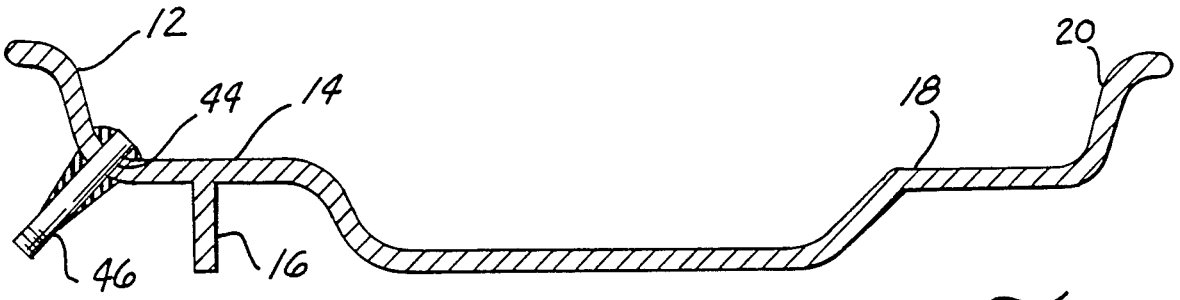
FIG. 6 is a sectional view a wheel rim constructed in accordance with the present invention having an increased positive wheel offset.

By varying the deformation of toroid 29 by the application of different pressures on dies 30, the radial flange 16 can be formed closer to the outer rim flange 12 to provide for increased positive wheel offset. Due to the inherent strength in the single piece rim formed by the aforesaid process, so positioning the radial flange 16 does not adversely affect the strength of the rim or the resultant wheel. To provide such an offset it is necessary originally to form the tube 30 with a larger diameter to accommodate the necessary inward bending during the spinning process in the shaping of the inner and outer rim portions to provide a rim of the type illustrated in FIG. 6 with the same transverse dimension as that shown in FIG. 2. It should also be noted that tube 30 could be made thicker during the forming process so that the resultant rim could accommodate a plurality of spokes for the forming of a wire wheel.

Various changes and modifications may be made in carrying out the present invention without departing from the spirit and scope thereof. Insofar as these changes and modifications are with the purview of the appended claims, they are to be considered as part of the present invention.

I claim:

1. A process for forming a single piece rim for vehicle wheels of the type having a radially directed flange for use in securing the rim to a wheel center, said process comprising the steps of pressing against a toroid of alloy material in opposite axial directions to cause said material to flow axially and radially so as to define a hollow tubular element of predetermined length having an annular inwardly directed radial flange intermediary of the ends thereof and spaced predetermined distances from the ends of said element; and bending the ends of said element radially outwardly and axially to define an inner rim flange and an outer rim flange.

2. The process of claim 1 wherein said pressing step comprises disposing a toroid of alloy material between a pair of axially aligned press dies and urging said dies axially inwardly against said toroid causing said material to flow about and between said dies so as to form said material into said tubular element.

3. A process for forming a single piece rim for vehicle wheels of the type having a radially directed flange for use in securing the rim to a wheel center, said process comprising the steps of pressing against a toroid of alloy material in opposite axial directions to cause said material to flow axially and radially so as to define a hollow tubular element having an annular inwardly directed radial flange intermediary of the end thereof; severing excess material from at least one end of said tubular element to define a predetermined overall axial length for said element and predetermined axial distances between said radial flange and each of said ends of said element; and bending the ends of said element radially outwardly and axially to define an inner rim flange and an outer rim flange.

4. A process for forming a single piece metal alloy rim for vehicle tires of type having an outer rim flange, an inner rim flange and a radially directed flange disposed therebetween for securing the rim to the wheel center, said process comprising the steps of disposing a toroid of metal alloy material between a pair of axially aligned press dies; urging said dies axially inwardly against said toroid at predetermined pressures displacing a first portion of said material about one of said dies, a second portion of said material about the other of said dies and a third portion between said dies, said first and second portions defining a tubular element of a predetermined finite length and said third portion defining an integrally formed radially extending flange disposed at predetermined axial distances from each of the ends of said tube; spin forming said first portion of material to define an outer rim portion and an outer rim flange at the extended end thereof and spinning said second portion of said material to define an inner rim portion and an inner rim flange at the extended end thereof.

* * * * *